United States Patent [19]

Dudley

[11] 3,985,958

[45] Oct. 12, 1976

[54] SECRET TELEPHONY

[75] Inventor: Homer W. Dudley, Summit, N.J.

[73] Assignee: Bell Telephone Laboratories, Incorporated, Murray Hill, N.J.

[22] Filed: Dec. 18, 1941

[21] Appl. No.: 423,437

[52] U.S. Cl. ..... 179/1.5 R; 179/1.5 M

[51] Int. Cl.[2] ..... H04K 1/04

[58] Field of Search ..... 179/1.5, 1.5 R, 1.5 M

[56] References Cited

UNITED STATES PATENTS

| | | | |
|---|---|---|---|
| 2,098,956 | 11/1937 | Dudley | 179/1.5 |
| 2,107,756 | 2/1938 | Kendall et al. | 179/1.5 R |
| 2,395,431 | 2/1946 | Sprague | 179/1.5 R |
| 2,405,599 | 8/1946 | Mitchell | 179/1.5 R |

*Primary Examiner*—H. A. Birmiel
*Attorney, Agent, or Firm*—H. A. Burgess

EXEMPLARY CLAIM

1. In secret telephony, means to analyze speech message waves into slowly varying currents representative of energy variations in respective portions of the speech frequency band, distributor means for rapidly switching fragments of said currents to line in rotation, a source of masing currents for each of said slowly varying currents, the masking currents each varying in magnitude in random manner, and synchronously operating means for adding masking current from a respective source to each fragment of the switched currents.

17 Claims, 8 Drawing Figures

INVENTOR
H.W. DUDLEY
BY
H. A. Burgess
ATTORNEY

INVENTOR
H.W.DUDLEY
BY
H. A. Burgess
ATTORNEY

INVENTOR
H. W. DUDLEY
BY
N. A. Burgess
ATTORNEY

SECRET TELEPHONY

The present invention relates to the transmission of speech or other signals with privacy. The invention in particular makes use of a type of transmission involving the analysis of speech or signal waves into relatively low frequency currents for transmission and synthesizing speech or signal currents at the receiving point under control of these low frequency currents. Such a method of transmission is disclosed and claimed in my prior U.S. Pat. No. 2,151,091, granted Mar. 21, 1939.

While the method of transmission disclosed in that patent possesses considerable privacy in that the speech cannot be received in intelligible manner without the use of specially built apparatus, the present invention provides a very much greater degree of privacy, approaching complete secrecy, by substituting for the relatively low frequency speech-defining signals other low frequency signals that are random in amplitude and so contain no signal information. For this purpose duplicate records are used at transmitting and receiving points and the recorded material is so combined with the transmitted signal currents as to render them incapable of recognition and use except as the message is extracted by use of the duplicate record at the receiver. Instead of using actual records, the material used for masking and unmasking could, where conditions permit, be supplied over an alternative transmission channel between transmitting and receiving points but in the disclosure to follow it will be assumed that records are used for this purpose.

Features of the present invention comprise, more particularly, the manner in which the masking currents are combined with the message currents for transmission and with the transmitted currents for recovering the message; the features relating to reentry, synchronizing and transmission or volume control, and the type of masking currents, including their production and use.

In its broader aspects the invention is not limited to use in a system involving analysis of the speech or other type of signal as above referred to and, in particular, the reentrant masking principle to be disclosed is capable of more general application.

These and the other features, and the various objects, of the invention will be brought out more fully in the following description and with the aid of the accompanying drawing.

Referring to the drawing,

FIGS. 1 and 2 when placed side by side with FIG. 1 at the left show in schematic circuit diagram a complete privacy system according to the invention, FIG. 1 showing the transmitting station and FIG. 2 showing the receiving station;

Figure 1:
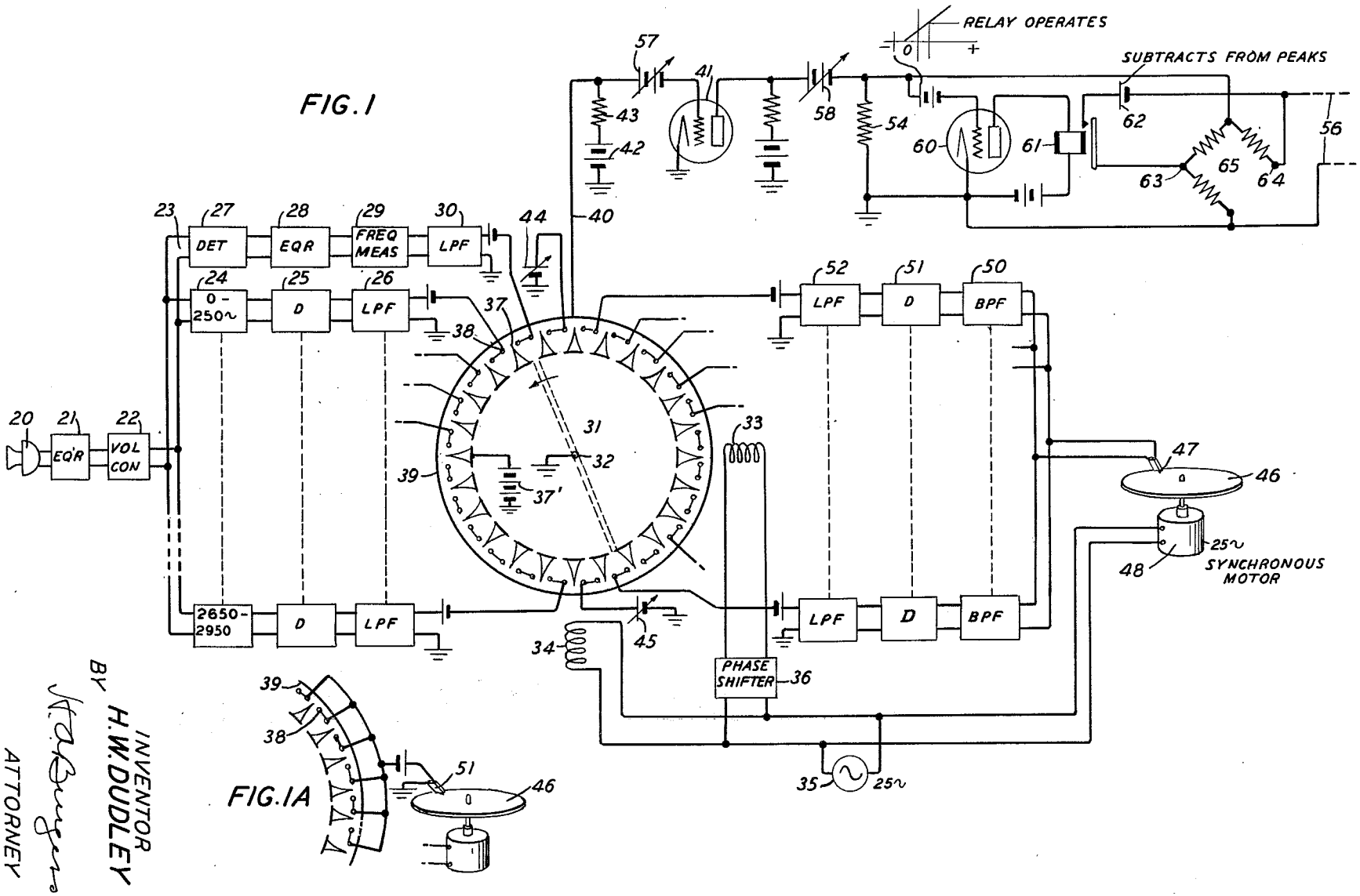
FIG. 1A shows a detail modification which may be made in the circuit of FIG. 1.

Referring to FIG. 1, there is shown at 20 a microphone or any other suitable source of input speech waves followed by an equalizer 21 and volume control

22. The output of the volume control 22 is branched into a fundamental pitch analyzer channel 23 and a suitable number of energy analyzer channels, assumed in this case for illustration to comprise ten channels, each including a subdividing filter such as 24 for subdividing the speech band into ten subbands. These band filters 24 may have any suitable ranges not necessarily of equal width. They may correspond, for example, to those shown in my prior U.S. Pat. No. 2,243,089, May 27, 1941, in which the lowest frequency filter passes the range 0 to 250 cycles and the highest frequency filter passes the range 2,650 to 2,950 cycles, these values being illustrative rather than limiting. Each such filter is followed by an integrating circuit such as detector 25 and a low-pass filter 26 having a pass range of, for example, 0 to 25 cycles representing syllabic frequencies. The output currents from the filters 26 are direct currents varying in amplitude at syllabic frequencies and the character of these currents may be seen from oscillograms published in my article entitled "The Carrier Nature of Speech" published in the Bell System Technical Journal for October 1940, Vol. 19, pages 495 to 515, the oscillograms being given in FIG. 10 on page 512.

The equalizer 21 following the input source 20 is designed to emphasize the amplitudes of currents of certain of the input frequencies with respect to others in such a way as to make the amplitudes of the speech-defining signals of the various channels more nearly equal. The volume control 22 may be of any suitable type of automatically controlled amplifier for maintaining constant output level to compensate for variations in strength of talkers, connecting lines, etc.

The fundamental pitch analyzing channel 23 includes a detector 27, equalizer 28, frequency measuring circuit 29 and low-pass filter 30 corresponding to similar elements in my U.S. Pat. No. 2,243,089 referred to above. The character of the pitch-defining current may be seen from the oscillogram in the publication referred to.

The output currents from the pitch-defining channel and the analyzer channels are used to control the operation of an electronic distributor 31 which may be constructed in accordance with the disclosure of A. M. Skellett U.S. Pat. No. 2,217,774, Oct. 15, 1940. This tube has a cathode 32 with means for focussing the emission into a well-defined radial beam and for causing the beam to rotate in a counter-clockwise direction so as to sweep over a plurality of electrodes arranged in the surface of a cylinder concentric with the cathode. The beam focussing and rotating means comprise magnetic coils of which two are shown at 33 and 34 supplied in this case with 25-cycle current from source 35, with a phase shifter 36 included in circuit with the field coil 33 to produce a 90° phase shift in the current to that coil whereby a rotating field is produced for rotating the beam at a rate of twenty-five revolutions per second.

This tube includes a number of shields 37 spaced from one another to leave small apertures. Included between the shields are vertical grid wires 38 and beyond the grid wires are corresponding anodes, in this case all connected together to form a complete cylinder 39 serving as a common anode. The envelope necessary for enclosing all of this tube structure is not shown. The beam is rotating is prevented from affecting the output circuit except when it passes over one of the apertures between two of the shields 37. When the beam registers with such aperture, electrons pass through the aperture and toward the anode and the strength of the anode current can be controlled at that particular instant by the voltage applied to the individual grid wires 38 located behind the aperture in question. The shields 37 with intervening spaces may be formed by slotting a cylinder, the slots forming the spaces and the metal between slots forming the shields. There are vanes or fins on the backs of these metal portions for isolating the grids electrostatically from one another. This cylinder is maintained at some high positive voltage and acts to accelerate electrons toward the anode, such source being shown at 37'. The common anode 39 is connected over an output lead 40 to the grid of amplifier 41. Plate voltage is supplied from battery 42 through resistance 43 to the cylindrical anode 39, the cathode 32 being shown grounded.

As the beam rotates, it, in effect, operates to transmit to the input of the amplifier 41 fragments of the pitch-defining current and the signal-defining currents from the analyzer since connections to the various grids from these various channels place potentials on the grids corresponding to the pitch-defining and signal-defining currents. These grid voltages determine the strength of output current produced during the short interval in which the beam registers with the corresponding aperture. In the construction illustrated, since there are ten energy-defining channels, one pitch-defining channel and one synchronizing channel, distributed around one-half of the circumference of the tube, the total number of apertures traversed by the beam in one complete revolution is 24 and, since the beam is assumed to rotate 25 times a second, the beam moves the angular distance of one channel in 1/600 second. The duration of impulse transmitted from each channel is, therefore, all or a part of 1/600 second, the width of the beam being such that current flow begins in any given channel at substantially the same instant as current flow ceases for the next preceding channel. The synchronizing channel referred to above may comprise any suitable means for impressing a synchronizing pulse on certain of the grids, shown in this case as comprising batteries 44 and 45 connected to diametrically opposite grids for effecting synchronism in a manner to be described more fully hereinafter in connection with the description of FIG. 2.

The portion of the system thus far described results in transmitting portions of the currents in the pitch channel and spectrum-defining channels in rotation to the grid of the amplifier 41. Since there are two radial beams in line with each other, one beam begins to pass over the twelve segments as soon as the other beam has passed off from the last of these twelve segments.

The eleven segments not accounted for by the segments connected to the analyzer channels and the two synchronizing channels are used for adding to the signaling pulses masking pulses derived from the record 46.

This record 46 is shown for simplicity of illustration as a phonographic disc but it may equally well comprise a photographic film record, magnetic tape record or any other suitable type. The record is driven by a 25-cycle synchronous motor from the source 35. Recorded on the record are currents of eleven different frequencies varying in amplitude among themselves in a random manner but holding to a constant amplitude for each 1/50 second or appreciable fraction thereof. (The manner in which this record is prepared will be described more fully in connection with FIG. 3.) The frequencies of these eleven currents may have any suitable or convenient values which permit them to be readily separated by the eleven band filters 50 in the analyzer system to which the pick-up device 47 leads. For example, these frequencies may comprise 750 cycles, 1,250 cycles and so on up to and including 5,750 cycles. The filters 50 select individual ones of these frequencies and the respective frequencies are detected in detectors 51 to produce corresponding variable direct currents which are filtered at 52 and applied to individual grids of the distributor tube occupying the right-hand half in the drawing. Since for best operation the grids require a negative bias, provision is shown in the drawing in the form of an individual battery in each of the grid leads for supplying such bias potential. (A common battery can be made use of if placed in the common ground lead.)

It will be observed that as one end of the beam is picking up a signal voltage from the speech analyzer, the opposite end of the beam is at the same instant picking up a masking voltage from the analyzer associated with the record 46. Additive currents are, therefore, sent through the resistance 43 and produce additive voltage effects on the grid of the tube 41. If, for example, a given signal pulse has an amplitude of five units and the corresponding masking voltage has an amplitude of three units, a voltage is produced on the grid of the tube 41 proportional to the sum or eight units. These are transmitted through the tube 41 and impressed across the coupling resistance 54 leading to the outgoing line 56. Variable batteries 57 and 58 may be used to bring the grid voltage of the tube 41 and the voltage of the ungrounded terminal of resistance 54 to the desired levels for best operation.

The tube 60 and associated apparatus now to be described are for the purpose of producing reentrant masking in order to provide a higher degree of privacy of transmission. By reentrant masking as applied to the present disclosure is meant that impulses above a certain amplitude are reduced by a fixed amount so that all of the impulses transmitted into line 56 lie within a predetermined range which is smaller than the range existing at the point in the circuit at which the coupling resistance 54 is located. The tube 60 is provided with a negative grid bias sufficiently great so that normally there is no plate current as indicated in the diagram above the tube. The polarity of the transmitted impulses is such as to make the ungrounded end of coupling resistance 54 positive in the case of each impulse. Each impulse, therefore, swings the grid of tube 60 in the positive direction, that is, in the direction to initiate current flow through the tube and through the relay 61. Only impulses in excess of a predetermined amplitude swing the grid sufficiently in a positive direction to produce output current corresponding to the threshold or operating current of relay 61. Currents of sufficient magnitude to operate relay 61 cause battery 62 to be momentarily connected between points 63 and 64 of the bridge network 65 with the result that the voltage of battery 62 is subtracted from the voltage across resistance 54 and the difference is sent to line 56. The voltage subtracted in each case is a fixed amount. For example, if the voltage range desired to be transmitted over the line 56 extends from zero to five units, the adjustments are such that as long as the summation of the masking pulse and the signal pulse is not greater than five units, the relay 61 remains unoperated. If the sum of the masking pulse and the signal pulse exceeds five units and becomes, for example, seven units, the operation of relay 61 in effect subtracts five units, bringing the line current in that case to two units. The line current, therefore, never exceeds five units.

This reentry feature in conjunction with the random masking currents originating from record 46 leads to production of a line current which contains no clue to the message. For example, suppose the message current is three units and that the masking current from the record is randomly zero, one, two, three, four or five units. The message plus masking current from tube 31 will then be three, four, five, six, seven or eight units randomly. For the case of three, four or five units there is no reentry current but for six, seven or eight units a reentry current of six units is subtracted leading to a value of zero, one or two units. Instead then of a message current of three units there is a line current upon combining the message, masking and reentry currents of zero, one, two, three, four or five units. The same range of line currents is obtained similarly with any other value of message current, zero, one, two, four or five. Accordingly, there is nothing in the line current to indicate what the original message current was. While six discrete values, zero, one, two, three, four and fve units have been assumed for the message and masking currents as a matter of simplicity, the principle holds equally well for the case of a continuous range of message and masking current. It is readily seen that for this degree of secrecy it is necessary to have both a random masking current and a fixed reentry current. By extension of the reentrant principle the given range of transmitted values may be gone through a greater number of times than two provided the maximum message pulse range does not exceed the value of the reentry pulse.

Reference was made above to transmission of a synchronizing pulse once each half revolution of the beam. This pulse may advantageously be of greater amplitude than any of the signal pulses and may produce on the line 56 the maximum of the chosen amplitude range of pulses or may, if desired, exceed such maximum. The relay 61 will under such circumstances respond to each of these synchronizing pulses to subtract the voltage 62 therefrom but the batteries 44 and 45 may be adjusted to the right value to give the desired amplitude to the synchronizing pulses, allowance being made for the subtraction of the voltage 62.

Figure 2:
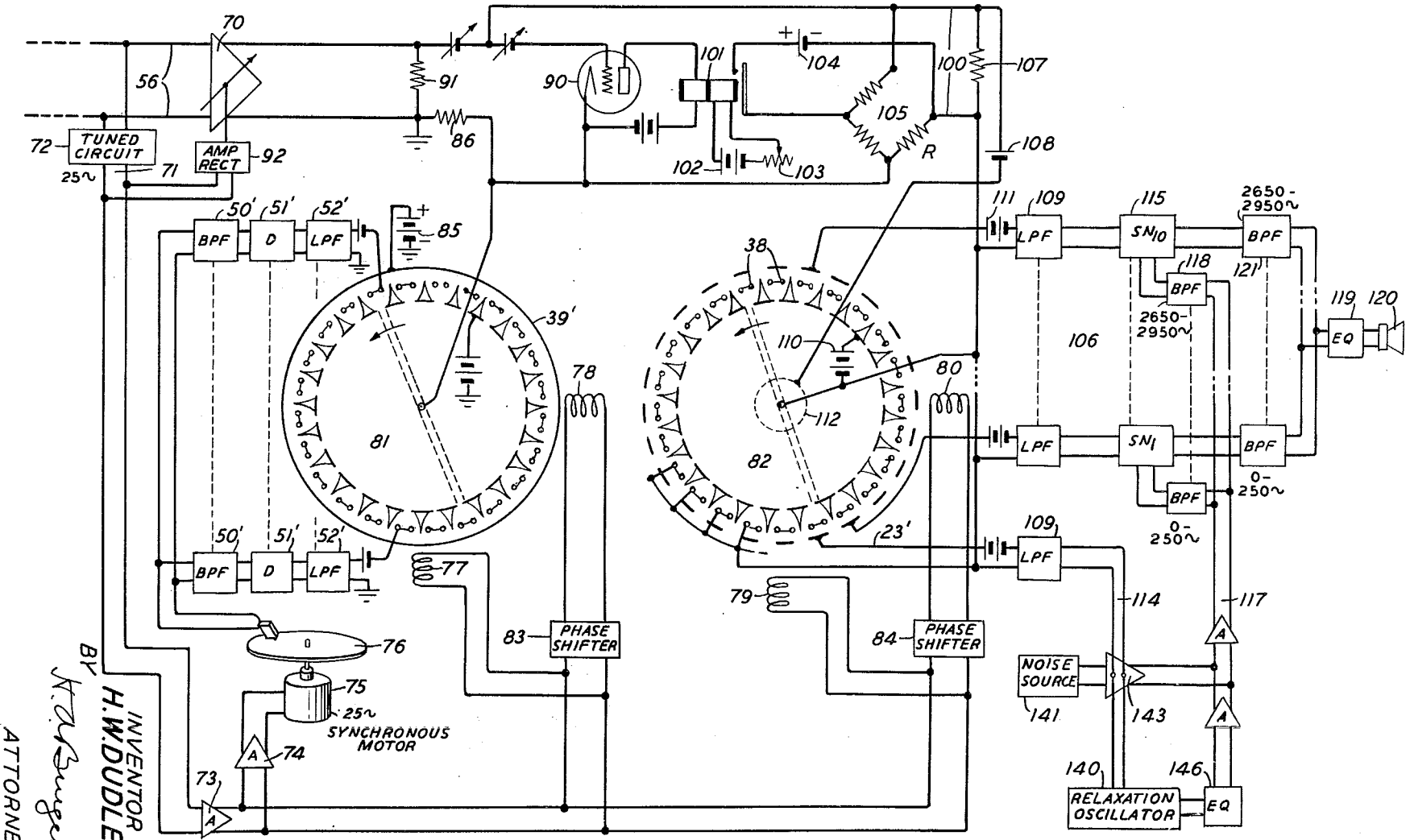

Referring to FIG. 2, the incoming pulses over the line 56 pass through a unidirectional device or direct current amplifier 70 into the receiving portion of the system. A portion of the received currents passes into the synchronizing branch 71 and through a tuned circuit 72, amplifiers 73 and 74 to the synchronous motor 75 for driving the record 76. Some of the 25-cycle current from the output of amplifier 73 is fed to the field windings 77, 78 and 79, 80 of a pair of electronic distributor tubes 81 and 82 to cause rotation of the beams in synchronism with the rotation of the beam in tube 31 at the sending station. Phase shifters 83 and 84 are provided in circuit with certain of the field windings as necessary to produce the rotating fields. The transmission of the pulses used for signaling will be irregular and during pauses will be reduced to zero, but masking currents may come on and be of the same root means square value as if messages were present. However, the synchronizing pulses are received at the constant rate of 25 cycles per second and, as stated, there may be of comparatively large amplitude so as to insure the constant supply of driving current for the record 76 and for the rotating fields for the distributors 81 and 82. A portion of the 25-cycle current from filter 72 is applied to amplifier-rectifier 92 for the purpose of automatically controlling the gain of amplifier 70 to compensate for transmission variations and maintain the received volume as constant as possible. The rectified voltage is used to control the grid bias in accordance with the well-known prior art practice.

The record 76 is assumed to contain duplicate recordings of those on record 46 at the transmitter and the records are assumed to be operating in synchronism and in phase with each other. The pick-up on the record 76 leads to an analyzer which may be identical with that used at the transmitter, comprising analyzer filters 50′, detectors 51′ and low-pass filters 52′ identical with the elements 50, 51 and 52, respectively, of FIG. 1. Masking pulses are, therefore, supplied to the grids of the distributor 81 identical in amplitude and in order of occurrence with those supplied to the corresponding elements of distributor 31. The common anode 39′ of the distributor 81 is supplied with space current from battery 85 which has its negative pole connected to ground. The cathode is connected to the ungrounded end of coupling resistance 86.

The masking impulses from distributor 81 produce current flow through resistance 86 which is in the grid circuit of tube 90. The received line impulses after amplification at 70 (which may be a two-stage direct-current amplifier) pass through coupling resistance 91 which is also included in the grid circuit of the tube 90. The received line impulses are of such polarity as to make the ungrounded terminal of resistance 91 positive while the impulses from distributor 81 make the ungrounded end of resistance 86 positive. The connection of the resistances 86 and 91 in the grid circuit of the tube 90 is such as to cause the impulses from distributor 81 to be subtracted from the pulses received from the line. In this manner the locally supplied masking pulses are subtracted from the received pulses so as to produce across the output line 100 pulses corresponding to the signal without the masking pulses.

Tube 90 and relay 101 are for the purpose of reversing the reentrant action produced by tube 60 and relay 61 at the transmitting station. Relay 101 is normally unoperated and is supplied with two opposed windings, one in the plate circuit of the tube 90 tending to oppose operation (weaken the flux in the core) of the relay and the other a bias winding in circuit with battery 102 and regulating resistance 103 tending to produce flux for operating the relay. Either a neutral or a polarized relay may be used for this purpose. In the absence of applied input voltage or in the presence of pulses tending to make the grid more positive there is sufficient current flow through the tube and the opposing winding to prevent relay 101 from closing its contact. When the grid of the tube 90 is driven sufficiently negative the current through this winding is weakened sufficiently to enable the biasing winding to cause closure of the relay contact. When the contact is closed battery 104 is connected across a diagonal of the bridge 105 in such polarity as to make the upper conductor 100 positive with respect to the lower conductor. Adjustable bias batteries in the grid circuit of the tube 90 are shown for obtaining the proper operating conditions of the tube.

The manner in which the reverse of the reentrant masking is effected may be seen from a simple illustrative example. First, let it be supposed that the received line current has an amplitude of three arbitrary units and that this is produced by a signal pulse of two units amplitude and a masking pulse of one unit amplitude. When this pulse is received the grid of tube 90 is driven positive by an amount proportional to the two units representing the effect of subtracting from the plus three units of line current one unit supplied from the tube 81 under control of record 76. The same two units of voltage are impressed on the circuit 100 the effect of which will presently be described. Let it next be supposed that the received line current is of three units amplitude, in this case resulting from a signal pulse of four units and a masking pulse of four units, making a total of eight units, which is translated by reentrant masking into the eventual three units of line current. In this case the line current of three units would by itself drive the grid of tube 90 positive three units but the decoding pulse from tube 81 applies minus four units of voltage to the grid circuit of tube 90, resulting in a net applied voltage of minus one unit. The adjustments described above are such that a negative pulse on the grid of tube 90 causes relay 101 to attract its armature, which it does in the case under consideration, and adds five units from battery 104 so that the voltage finally appearing across circuit 100 corresponds to four units and represents the original signal pulse freed of the masking pulse.

The distributor tube 82 distributes the recovered signal pulses in circuit 100 to the different channels of a speech synthesizer 106 which may be of the same type as disclosed in my prior patents referred to above. In this case the tube 82 has its cathode connected to the lower side of coupling resistor 107 in circuit 100 and the cathode is surrounded by a cylindrical grid 112 which is connected to the upper terminal of coupling resistor 107 through a suitable bias battery 108 if necessary. Tube 82, in contrast to tubes 31 and 81, does not have its individual anodes connected together, but they are left separate and eleven of them are individually connected to low-pass filters 109 in the synthesizer 106. It would be possible in this case to use a distributor tube having a lesser number of elements but for convenience of showing it is assumed that a twenty-four-anode tube is used similarly to the other distributor tubes of the system. In this case the grid wires adjacent the anode corresponding to grid wires 38 of FIG. 1 serve as accelerating electrodes and are all connected in common to positive battery 110. The anodes leading to the individual filters 109 have individual anode batteries 111.

From this point on the operation of rebuilding the speech is the same as disclosed in my prior patents referred to. The speech is reconstructed from local sources of energy representing voiced and unvoiced sounds and comprising, respectively, a relaxation oscillator 140 and noise source 141 corresponding to relaxation oscillator 40 and noise source 41 of my prior U.S. Pat. No. 2,243,089. A switching amplifier 143 is shown corresponding to switching amplifier 43 of that patent. Equalizers may be provided as necessary, one being shown, for example, at 146. The fundamental pitch channel is shown at 23' and comprises low-pass filter 109 for reproducing in branch 114 leading to switching amplifier 143 a slowly varying pitch-defining current corresponding to that present in the output of filter 30 of FIG. 1. It will be understood that this is produced by pulses from the segment of distributor tube 82 which is devoted to the reception of the pulses from the fundamental pitch channel.

Each of the ten synthesizer channels includes a synthesizer circuit or modulator $SN_1$ to $SN_{10}$, shown at 115. The purpose of these is to combine the waves from the relaxation oscillator 140 or noise source 141 with speech-defining currents recovered in each of the channels of the synthesizer 106, to be constructed into understandable speech. The waves from these artificial sources are supplied with suitable amplification over branch 117 and individual selective band filters 118 to the individual modulators 115. Integrated pulses from distributor 82, transmitted through filters 109, are applied to the other input terminals of the modulators 115 and the output of the various modulators pass through band filters 121 and through equalizer 119 to reproducer 120 which may be a loud-speaker, the input of a telephone line or other suitable receiver. Equalizer 119 may be complementary to equalizer 21 of FIG. 1.

Reviewing briefly the operation of the entire system, it is seen that the tubes 31 and 82 operate as rotary distributors for transmitting the pitch-defining and spectrum-defining currents on a multiplex time division basis from transmitter to receiver. The distributor 31 also cooperates in adding masking currents to the pitch-defining and spectrum-defining currents to mask their identity and the reentrant masking circuit 60 to 65 increases the degree of secrecy by completing the confusing of the identity between original signal pulse and line current. The distributor 81 deciphers the received line currents and with the aid of the reentrant circuit 90, 101–105 delivers the deciphered line currents to the circuit 100. The distributor 82 translates these into restored pitch-defining and spectrum-defining currents in the synthesizer 106 where they are rebuilt into understandable speech by modulation with the local sources of voiced and unvoiced waves. During this process synchronizing pulses are transmitted and serve to provide driving current to the devices at the receiver for maintaining the necessary degree of synchronism between records 46 and 76 and between the distributor tube 31 on the one hand and distributor tubes 81 and 82 on the other hand.

The foregoing description assumes transmission over the two-wire line 56 leading from the transmitting station in FIG. 1 to the receiving station in FIG. 2. The invention also contemplates any other suitable type of transmission medium, such as a carrier wave channel or radio channel of any known or suitable type. In case, however, a wire line is used, as specifically shown, this may be a land line, or a submarine cable, or other suitable line. The system is well adapted to submarine cable transmission in view of the relatively narrow band width required.

The foregoing description assumes that the various values of line current mentioned are to be measured from zero current. Since there is always a certain amount of noise current present in any transmission channel, it would be desirable to use for the signal transmission a current range which does not extend all the way down to zero but extends between suitable finite values in order to avoid false reentry pulses at the receiver. For this purpose the bias batteries for the grids 38 of FIG. 1 may be initially adjusted to permit the transmission of a given value of current when no signals are present in the system. Compensating adjustments are then made in the other biasing batteries of the system, for example, those used on the grids of distributor tubes 81 and 82 and the bias voltages for tube 90.

It will be observed that a reentry pulse should be thrown in at the receiver only when the decoded pulse applied to tube 90 is negative, and that the reentry pulse is positive and equal in amplitude to the maximum message amplitude, in the specific example assumed above. When the decoded pulse applied to tube 90 is positive and of small amplitude, noise on the line may be of sufficient negative amplitude to overcome the small positive message pulse and cause introduction of the reentry pulse falsely. Again, when the decoded pulse is negative and of small amplitude the line noise may be positive and of sufficient amplitude to overcome the message pulse and prevent addition of a reentry pulse when one is needed. The first type of false reentry can be avoided by use of a bias voltage as above described, and the second type of false reentry can be avoided by use of a reentry point appreciably larger than the maximum message amplitude to be sent, (by adjusting the operating point of tube 60 and relay 61) so that when the reentry pulse is subtracted before transmission the resultant pulse sent over the line is above a stated minimum. For example, if the message range is zero to 100 units, use of a bias of 10 units to shift the message range to 10 to 110 units and use of a reentry value of 120 units (ten greater than the maximum transmitted message value) will protect against false reentry due to line noise up to ten units of amplitude.

FIG. 1A represents an alternative method for impressing masking currents on distributor tube 31 from record 46, which places severer requirements upon the degree of synchronism between the records and distributors at the respective stations but which otherwise results in simplicity by omitting the band-pass filters 50, detectors 51 and low-pass filters 52. A corresponding modification would be made at the receiver with corresponding simplification in circuits.

In the modification shown in this figure the record is assumed to have recorded upon it direct currents of random magnitudes in the form of a stepped wave of which the current of any one magnitude and representing one masking current has a duration of 1/600 second, corresponding to the length of contact which the distributor makes with any one channel. When the beam passes to the next segment of the distributor tube the record impresses a fresh masking pulse on the corresponding grid 38 and this process continues in properly timed relation provided the proper synchronism is maintained between the record and the distributor beam. This method may be suitable where the synchronizing problem is not too severe. However, in the case of long channels, such as long radio links where fading and other effects may be present, simpler synchronizing apparatus may suffice if the masking pulses are recorded on the records in the form of waves of different frequency and amplitude as previously described. It is pointed out that when this is done it is not necessary to have all eleven of the high frequency waves recorded so as to be reproduced simultaneously, but that the synchronizing requirements may be greatly relaxed if any given masking current persists for only a few time division units of the distributors. For example, a given masking pulse may be recorded so as to persist even after selective filtering, rectifying and low-pass filtering at essentially a constant level for six or eight or ten distributor contact times and the next masking current may begin one commutator segment later and maintain a constant level for a similar length of time. In such case the analyzers for the masking pulses in the case of both transmitter and receiver will normally place the masking pulses on the grids of the distributor tubes before they are actually needed and will maintain them for a time after they are actually needed so that the records may be out of synchronism with the distributors by a corresponding amount before trouble occurs.

Where conditions permit use of impulses of direct current of masking impulse duration as in the case of the record assumed in FIG. 1A, these impulses can be inserted directly into the line circuit without going through tube 31, if desired. For example, pick-up 51 could be connected in series with resistance 54 or in the input circuit of tube 41 or at other suitable point ahead of the reentrant switching tube 60.

To avoid the need of direct-current (zero frequency) pick-up from the record 46 by pick-up 51 and direct-current transmission to grids 38, it may be desirable to record the masking current on record 46 as the amplitude of some convenient carrier frequency, such as 4,800 cycles. In this case the current from pick-up 51 would go through a rectifier and a purifying low-pass filter to recover the flat pulses of duration of 1/600 second each to be used in masking.

Figures 3, 3A:
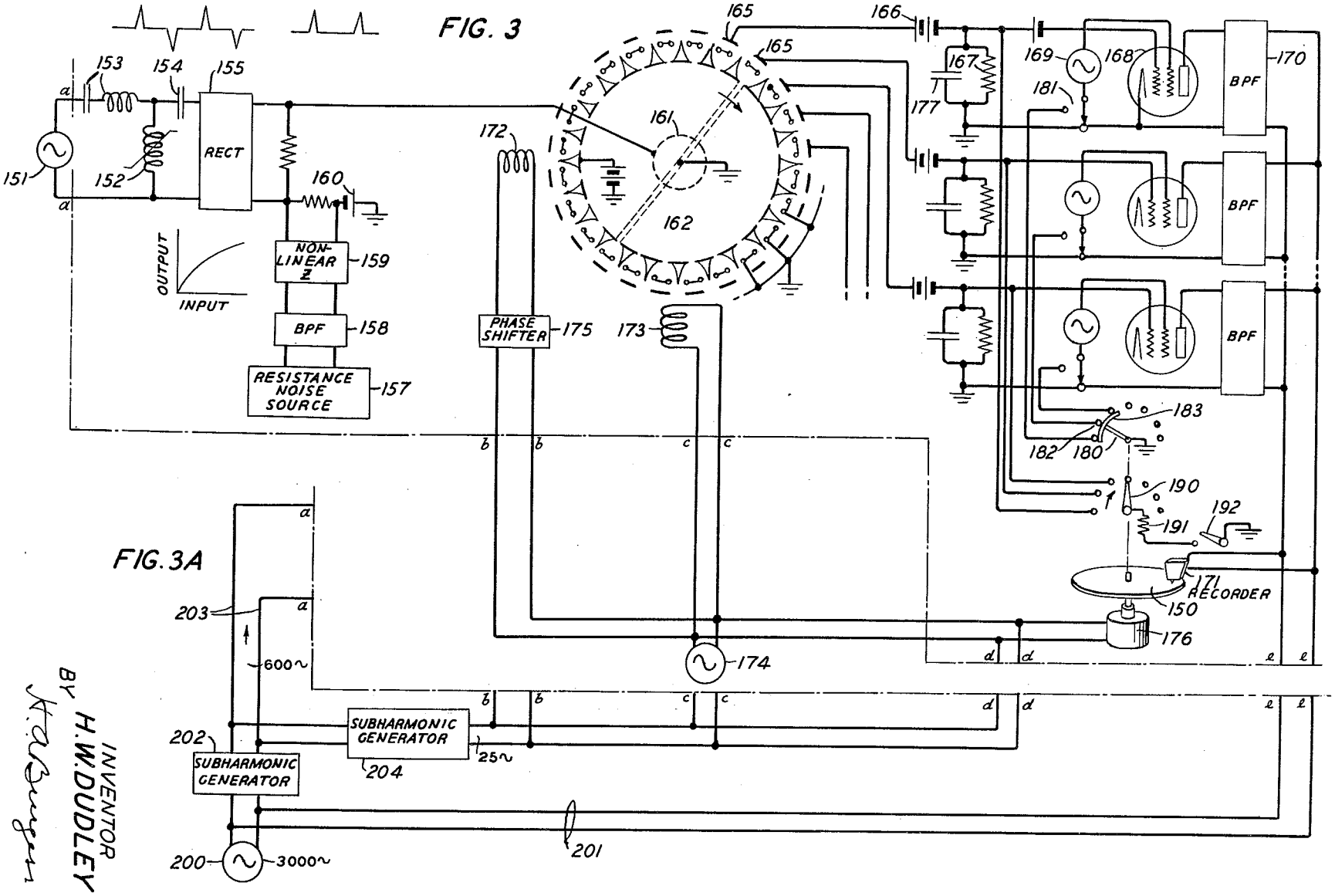
FIG. 3 is a schematic circuit diagram of a system for producing currents varying in random manner for use as masking currents for the system of FIGS. 1 and 2.
FIG. 3A shows a modification that may be made in FIG. 3 by substitution below the broken line a-e.

Referring now to FIG. 3, a system is disclosed for producing currents varying in strength in random manner from one time interval to another which may be used directly as produced for masking signaling currents but are shown as recorded upon a record 150 for future use in connection with signaling.

A source 151 which may be a sine wave oscillator generates waves of some convenient frequency such as 600 cycles per second. These are used in conjunction with a saturable core inductance 152 to produce a series of short, sharp impulses as shown by the graph immediately over the coil. The circuit including the inductance 152 may be tuned with the aid of series capacity and inductance, 153, and the sharp impulses are transmitted through condenser 154 to half-wave rectifier 155 which removes the negative pulses and impresses the positive pulses on the grid 161 of the tube 162 which may be similar to the rotary beam tubes previously described. A source of resistance noise 157 is connected through a band-pass filter 158 and a network 159 having a non-linear input-output characteristic for limiting the amplitude range and more nearly equalizing the rate of occurrence of any peak amplitude in a given amplitude range as indicated by the characteristic placed adjacent the network in the figure. Band-pass filter 158 selects a range of frequencies preferably of the order of 2 kilocycles or more in width. The tube 162 to which network 159 is connected has its grid normally biased by battery 160 to such a negative value that none of the resistance noise is transmitted through the tube except at the instant when one of the sharp peaks of voltage from rectifier 155 is impressed on the grid. The adjustment is such that the magnitude of current which flows through the tube 162 is determined by the instantaneous amplitude of the resistance noise wave at the instant when the peak of the impulse from rectifier 155 occurs. Since this peak has a duration which is only a small fraction of the period of oscillator 151 and, therefore, only a small fraction of 1/600 second, the tube 162 transmits these short impulses of current once every 600th second, varying in amplitude in fortuitous or random manner as determined by the amplitude of the resistance noise at the particular instant.

The anodes 165 of distributor tube 162 are individually connected to ground through respective plate batteries 166 and resistances 167. In one form, as illustrated, each of these resistances is shunted by a capacity 177 and is included in the grid circuit of a modulator tube such as 168. Each such tube 168 is supplied from a source of high frequency such as 169 which may conveniently be connected to a second grid in the same tube. These sources, of which there are eleven in the assumed example, have frequencies of 750, 1,250 and so on up to 5,750 cycles per second. Band filters 170 which may be simple tuned circuits are made individually selective to these different frequencies and the currents transmitted through these various band filters are led in common to a recording device 171 on record 150.

The beam in the distributor tube 162 is focussed and rotated by means of a rotating field produced by field coils 172 and 173 supplied with current from generator 174, phase shifter 175 being included in circuit with field coil 172. The driving motor 176 for the record 150 may be supplied from the same source. Likewise generator 151 instead of being an independent source may advantageously be geared to or its wave derived from source 174. For example, if source 174 has a frequency of 25 cycles per second, the wave supplied at 151 may be derived from a harmonic generator coupled to source 174 and delivering the twelfth harmonic at 151.

The operation of the circuit of FIG. 3 as thus far described will now be outlined. Each time one of the voltage peaks is impressed on the grid 161 it drives the grid positive for a brief instant and allows the beam to transmit current to the corresponding anode 165, thereby placing a charge on corresponding capacity 177. The pulses transmitted through the tube 162 occur every 1/600 second so that each pulse transmitted through the distributor 162 produces current flow to a different anode, thus charging the condensers 177 in rotation. These condensers are proportioned in size so that they are completely charged by the substantially instantaneous pulse transmitted to them from distributor 162 and the magnitude of the resistance 167 is such as to hold the charge on the condenser substantially undiminished throughout the complete rotation of the beam. When the beam next comes opposite a given anode 165 it charges the corresponding capacity 177 to a new value either less or greater than it previously had and the new value is determined by the amplitude of the pulse from network 159.

The high frequency wave from each source corresponding to source 169 is transmitted through the tube such as 168 with an amplitude determined by the charge on the capacity 177 in each case. With the arrrangement as thus described, each such high frequency wave is recorded on the record 150 with a given amplitude for the duration of one-half revolution of the beam of tube 162 and with the same or a different amplitude for the next half revolution, depending upon the amplitude of the pulse determining the condenser charge for each such half revolution.

If it is desired that the record of each wave, such as the wave from source 169, should not last for a half revolution of the beam, the timer 180 may be switched into circuit. To do this, each of the switches 181 associated with the respective source 169 will be thrown to its alternate position in the drawing, thus connecting such source to a respective contact 182 on the timer. The timer has a rotating sector 183 of such angular width as to cover any given number of the contacts 182 when in one position and it is rotated at twice the speed of the beam of distributor 162. By means of this timing device the modulators 168 transmit the respective high frequency waves for any desired fraction of the rotational period of the distributor instead of for the entire period.

To facilitate the placing of definite charges on the condensers 177, means may be used for discharging each condenser to some desired extent just before it is to be recharged from distributor 162. This could be done in various ways but for simplicity of disclosure a rotating arm 190 is shown driven from the same shaft as timer 180 and wiping over successive contacts wired to the ungrounded terminals of the various condensers 177. Arm 190 may be made effective by closing switch 192 thereby connecting arm 190 to ground through resistance 191 which determines the extent of discharge for a given contact time. Arm 190 is shown advanced in phase with respect to timer 180 and it is also in advance of the beam in tube 162, the relation being such as to discharge each condenser and then pass on to the next one just ahead of the time when the charging impulse occurs.

While the noise source 157 is here described as a resistance noise source it may advantageously be a gas-filled tube in continuously conductive state since this generates noise at very much higher level than does the usual resistance noise source and so requires less amplification.

Figure 6:
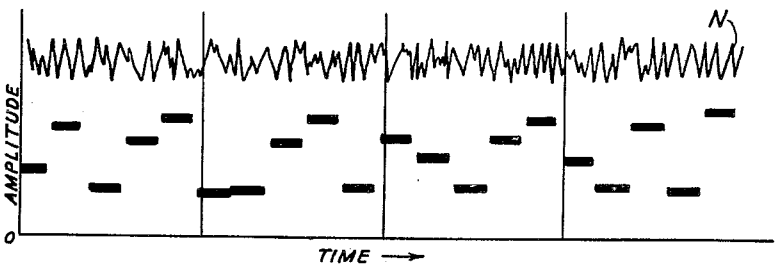
FIGS. 5 and 6 show oscillograms illustrating different conditions to be referred to in the description of FIG. 3.
Figure 5:
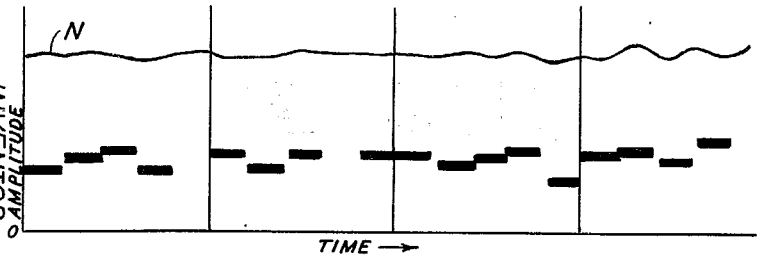

The manner in which currents or voltages having amplitudes with random distribution are derived from resistance noise waves is illustrated by the graphs of FIGS. 5 and 6. These graphs are copies of oscillograms in which in each case the noise wave generated in a gas-filled tube, after being passed through the band-pass filter 158 and limited by the non-linear circuit 159 is shown at N for two different pass-bands for filter 158. In FIG. 5 the filter 158 passed the range 0 to 300 cycles; and in FIG. 6 the range was 0 to 2,000 cycles. The amplitudes of pulses (shown by dashes), in this case having a duration of 1/500 second, are given by the vertical distance above the zero line in each figure.

The point of principal interest in FIGS. 5 and 6 is that the pulses in FIG. 5 do not have truly random distribution. The reason for this may be seen from the character of the noise wave from which they are derived. In FIG. 5 the noise wave has too much regularity to provide a random distribution of pulses when sampled as rapidly as five hundred times per second. Where the pass-band was of the order of 2,000 cycles or greater, however, it was found that the pulses have a truly random distribution of amplitude with time since several complete periods of variable amplitude and frequency elapse between sampling points.

This feature of the invention by which a quantity (in this case, current) having a random distribution of magnitudes with time is produced is capable of general application and may be especially useful where the random values are to be supplied indefinitely and at a rapid rate. It avoids such laborious and time-consuming processes as selecting numbers by chance, as in drawing numbers from a hat, flipping coins, rolling dice, etc.

While the method of synchronizing shown in FIGS. 1 and 2 has the advantage of simplicity and may suffice where only simple and straightforward transmission is involved, it is desirable to provide a synchronizing method that will meet the more exacting requirements encountered in long transmission systems subject to varying characteristic fading or other effects. The synchronizing must by very close since impulses of the order of 1/500 second duration are to be balanced against each other in amplitude and phase. It is desirable that not merely the driving motors for the records but the reproductions from the records themselves be synchronized. Moreover, since the ciphering and deciphering involves addition and subtraction of current amplitudes, it is important that correction for variable line attenuation be accurately and quickly effected in order that, so far as possible, the received volume be constant. Otherwise the relation between the magnitude of the masking pulses taken from the record at the receiver and the magnitudes of the received currents from which the masking pulses are to be subtracted would vary from time to time under varying transmission conditions, giving a distored signal. In order to enable the automatic gain control to follow sufficiently closely such effects as fading in short wave radio transmission a higher frequency control wave than the 25-cycle wave given by way of example in FIGS. 1 and 2 may be of value.

For such a synchronizing control, more adequate to long radio channels and the like, reference will now be made to FIGS. 3A and 4. In order to provide a pilot wave which can be used to synchronize reproductions from the records, themselves, and to control the receiving gain in adequate manner, a 3,000-cycle wave is recorded on the records along with the masking currents. The frequency, 3,000 cycles, is chosen as high enough to lie well above the transmission frequency band and high enough to serve as a gain control pilot, but any other suitably high frequency may be used.

In FIG. 3A the 3,000-cycle wave is generated in a standard frequency source 200 which may be a crystal controlled oscillator or other means of generating a constant frequency wave. Some of this is taken over leads 201 directly to the recorder 171 and recorded on record 150 along with the masking waves.

Some of the waves from source 200 are impressed on subharmonic generator 202, to produce by subdivision of the frequency a wave of 600 cycles to be used in place of generator 151, supplied over leads 203. A second subharmonic generator 204 divides some of this 600-cycle wave still further to supply 25-cycle wave to drive the field of the tube 162 and the motor 176 in substitution for the source 174. In this way, a suitably close control over the frequency and phase of the different parts of the record producing system is assured and a constant frequency pilot wave is recorded on record 150. The subharmonic generators may be of the type shown in Miller U.S. Pat. No. 2,159,595, May 23, 1939, or other suitable type.

Figure 4:
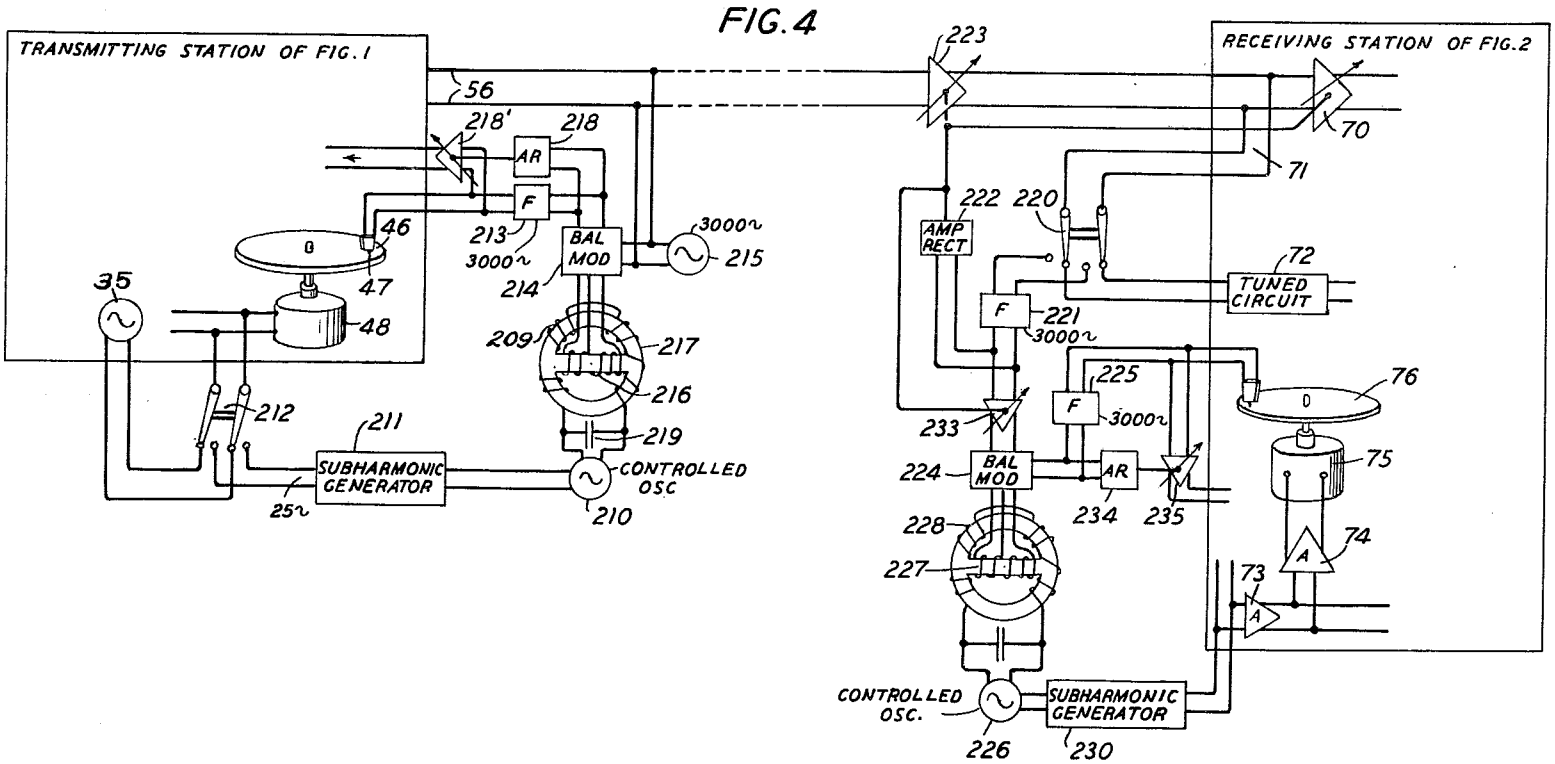
FIG. 4 shows a modification that may be made in the system of FIGS. 1 and 2.

FIG. 4 illustrates the use of the record containing the 3,000-cycle pilot wave recorded thereon for synchronizing purposes and also for gain control. FIG. 4 assumes a transmitting station the same as in FIG. 1 and a receiving station the same as in FIG. 2 except for certain modifications and additions to be described.

Instead of driving the motor 48 and distributor tube 31 from source 35, a source 210 working through a subharmonic generator 211 may be used. This source may have any suitable frequency such as 1,000 cycles, and is substituted by shifting switch 212 to its alternate position to supply a subharmonic wave of 25 cycles to motor 48. The record 46 is assumed to have a 3,000-cycle wave recorded on it as disclosed in connection with FIG. 3A. This 3,000-cycle pilot wave is picked off by filter 213 and used for synchronizing and volume control of the reproductions from the record.

Some of the 3,000-cycle wave from filter 213 is impressed on balanced modulator 214 where it is caused to beat with a 3,000-cycle wave from the constant frequency oscillator 215, which may be an independent crystal oscillator or other source of constant frequency. If the two waves impressed on the balanced modulator 214 are in synchronism and phase agreement they produce no resultant direct current through the winding 216 on the diamentral leg of the core 217. The annular core portion carries winding 209 which forms the tuning inductance of the oscillator 210, the tuning capacity being shown at 219. The effective inductance of winding 209 depends upon the degree of saturation of the core and this is determined by the direct current in winding 216. The arrangement is such that as the two 3,000-cycle waves applied to the modulator 214 tend to get out of phase with each other this tendency is opposed by the development of a biasing current in winding 216 which changes the tuning of the oscillator 210 either to accelerate or decelerate the motor 48 to restore the in-phase relationship between the two 3,000-cycle waves. This method of control in and of itself as applied to an oscillator is disclosed in Affel U.S. Pat. No. 1,450,966, Apr. 10, 1923. It will be noted that the control circuit described operates from the record itself and since the masking waves are recorded on the same record in fixed relation to the recorded pilot wave, this method insures constancy of frequency of both the reproduced pilot wave and the masking waves. The leads extending toward the left from the motor 48 indicate that the same source of 25cycle driving current is used for the field of the distributor 31.

For purposes of volume control of the masking waves reproduced from record 46 some of the 3,000-cycle wave obtained from the output of filter 213 is applied to an amplifier-rectifier 218, the output of which controls the gain of amplifier 218' through which the reproduced masking waves pass so as to compensate for variations in level of the recorded waves which may be variable over different parts of the record due to various causes. The control of the gain of variable amplifier 218' may be accomplished in a well-known manner, such as by varying the grid bias in accordance with rectified and filtered current in the output of amplifier-rectifier 218.

For purposes of synchronizing the level compensation for the transmission channel (whether wire or radio) some of the 3,000-cycle pilot wave from generator 215 is unpressed on the outgoing line 56. This wave should, of course, be of constant amplitude.

At the receiving station in the right-hand portion of FIG. 4 the switch 220 will be thrown to the left if the 3,000-cycle pilot wave is to be used. This cuts off the 25-cycle filter 72 and sends the 3,000-cycle pilot wave, as received from the line, through filter 221. Part of the wave is sent to amplifier-rectifier 222 to develop a direct voltage bias for governing the gain, either of amplifer 223, which may be an additional amplifier, of amplifier 70, or both. The gain is varied to compensate for transmission variations due to fading, attenuation or other causes, and to maintain constant received volume. A further gain control leads from the output of amplifier rectifier 222 to amplifier 233 to control its gain to maintain constant output volume.

A portion of the 3,000-cycle wave from filter 221 is applied to balanced modulator 224 through amplifier 233. The 3,000-cycle wave from the record 76 is applied through filter 225 to the balanced modulator 224 and these two applied waves operate to control the tuning of the oscillator 226 by way of coils 227 and 228 in the manner described in connection with oscillator 210. Motor 75 and the fields of the distributor tubes are driven from oscillator 226 through a subharmonic generator 230. The relationship is such that record 76 is held in close synchronism and phase with the pilot wave received from the distant station, which means, of course, that the reproduced masking impulses are held in close synchronism and phase with respect to those coming in over the transmission channel. These impulses are kept in fixed amplitude relation also by the use of the pilot wave for gain control purposes as described heretofore.

A portion of the 3,000-cycle pilot wave obtained from the output side of filter 225 is applied to amplifier-rectifier 234 for developing a control bias for amplifier 235 to maintain constant volume in the masking waves reproduced from record 76 for use in recovering the signal.

The invention has been disclosed with reference to the multiplex transmission of the signals in the eleven analyzer channels, but the principle of reentry disclosed is not dependent upon multiplexing, since it may be applied equally well to a single channel system in which case the distributor tubes 31, 81 and 82 would be omitted and the signal currents present in such single channel and the masking currents would then be applied directly to the input of tube 41 or other line input connection ahead of the reentry circuit 60 to 65 at the transmitter; and the received line current and masking currents would be applied to the input of reentry circuit 90 at the receiver, the output from bridge 105 leading to the signal receiver or restorer. The invention is not limited, of course, to the transmission of a partiuclar type or kind of signal. It will be noted that the current in any one analyzer channel has the general characteristics of telegraph or other signal current, and the invention comprehends use of the various known kinds of sending and receiving signal systems or apparatus using communication currents of varying amplitude to which the masking currents and reentry coding can be applied.

The invention is not limited to the specific circuit or apparatus details disclosed herein nor to be numerical quantities of values given but the scope is defined in the claims, which follow.

What is claimed is:

1. In secret telephony, means to analyze speech message waves into slowly varying currents representative of energy variations in respective portions of the speech frequency band, distributor means for rapidly switching fragments of said currents to line in rotation, a source of masking currents for each of said slowly varying currents, the masking currents each varying in magnitude in random manner, and sychronously operating means for adding masking current from a respective source to each fragment of the switched currents.

2. In a speech privacy system, means for deriving from each of a plurality of different frequency regions of the speech band a slowly varying speech-defining signal, a transmission channel, means for rapidly switching fragments of said signals to said transmission channel in rotation, means for supplying masking currents varying in amplitude in random manner and means for adding portions of such masking currents to said switched fragments.

3. In a speech privacy system, means for deriving from each of a plurality of different frequency regions of the speech band a slowly varying speech-defining signal, a transmission channel, cyclically operating switching mechanism for sampling said signals in rapid rotation and switching the sampled portions to said transmission channel, whereby a current is produced in said channel which is a composite of the various signals juxtaposed in time, means to add extraneous currents to said current in said channel to mask its identity for purposes of privacy, and means for reducing the total amplitude range of the resultant currents transmitted.

4. In a speech privacy system, means for deriving from each of a plurality of different frequency regions of the speech band a slowly varying speech-defining signal, a transmission channel, distributor means for selecting short portions of said signals in rapid succession and impressing them upon said channel for transmission, a record of random current strengths, means to reproduce the recorded currents and add them to the signals in said channel whereby the amplitude relations of the signals are altered, and means to limit the total amplitude of the transmitted currents comprising means to reduce by a fixed amount the amplitudes in excess of a predetermined maximum.

5. In a speech privacy system, means for deriving from each of a plurality of different frequency regions of the speech band a slowly varying speech-defining signal, a transmission channel, electronic commutator means of the type having a movable beam sweeping in succession over a plurality of electrodes, means to place said signals in circuit with electrodes of said commutator whereby fragments of said signals are impressed on said transmission channel in rapid succession, a record having recorded thereon a random successon of currents of various amplitudes, and means to pick off said recorded currents and apply them to electrodes of said electronic commutator means, said commutator means operating to add the currents from said record to the fragments of signals impressed on said channel to mask the identity of the latter.

6. In a speech transmission system, means at a transmitting point for deriving from each of a plurality of different frequency regions of the speech message band a slowly varying current representative of the energy variations with time occurring in the respective frequency region of the speech message band, a transmission channel leading to a receiving point, rapidly operating distributor means for transmitting to said channel short fragments of said currents in rotation, synchronously operating distributor means at the receiving point for reproducing from said transmitted currents a plurality of slowly varying currents corresponding respectively to the slowly varying currents derived at the transmitter, means at the transmitting point from adding an individual masking current to each such transmitted fragment of current, means at the receiving point for subtracting a duplicate of each such individual masking current from the received currents, and means for reconstructing the speech message under control of the reproduced slowly varying currents.

7. In a speech transmission system, means to analyze speech message currents into a plurality of slowly varying currents simultaneously existent in a corresponding plurality of separate circuits, distributor means to switch short fragments of said currents to line in rapid rotation, means to separately produce a corresponding plurality of currents each varying in amplitude in time correspondence with the switching rate of said distributor means, and each having random distribution of amplitude among successive switching times, and means to add said separately produced currents individually to the fragments of said slowly varying currents as the latter are switched to line, to mask the identity of said fragments.

8. A system according to claim 7, including a reentrant coding circuit for reducing by a fixed amount the amplitudes of the currents resulting from addition of said switched fragments and separately produced currents, whenever such resulting currents have amplitudes in excess of a definite magnitude.

9. In a speech privacy system, means for analyzing speech message waves into fundamental pitch-defining signals and spectrum-defining signals continuously varying in amplitude, means for adding to both of said kinds of signals masking currents of amplitudes varying in a manner unrelated to the message current variations, to produce summation currents of signal plus masking currents, and means to subtract from said summation currents whenever their amplitude is in excess of the maximum signal amplitude a fixed amplitude equal to the maximum signal amplitude, to increase the masking of said signals.

10. The method of producing currents in successive intervals of time, varying in amplitude from one interval to the next in random manner, comprising generating noise waves of continuous energy frequency spectrum such as resistance noise waves, sampling said waves at the start of each time interval to obtain a measure of the instantaneous amplitude of the wave at such instant of time, producing a current of corresponding strength, maintaining the current at that strength throughout the particular interval of time, and selecting from the generated noise waves a sufficiently wide range of frequencies for the sampling so that several complete periods of variable amplitude and frequency elapse between successive instants of sampling.

11. The method of generating masking signal currents for providing privacy comprising generating continuous spectrum noise energy, selecting energy in a band of frequencies of the order of 2 kilocycles in width, sampling the energy in said band at definitely spaced time intervals short in comparison with the fundamental wave period of signal to determine from the instantaneous amplitude of the energy, at the instant of sampling, the amplitude of masking current to be used in the particular sampling interval, producing a current of sampling interval duration and of said amplitude and combining said masking currents with the signal currents prior to transmission.

12. The method of generating masking currents having a random distribution of amplitudes comprising generating continuous spectrum energy, slecting said energy in a band of frequencies of the order of 2 kilocycles in width as minimum, producing a series of timing inpulses recurring at a frequency lower than the magnitude of said width of band, sampling the instantaneous amplitude of the energy in said selected band at the instants of occurrence of said timing pulses to determine the amplitude of masking current and generating masking currents of said determined amplitudes and of a duration from one timing pulse to the next.

13. A secret system of transmission for currents varying in amplitude in accordance with signals comprising means to add thereto masking currents varying in amplitude in a manner unrelated to the signal variations to produce summation currents of signal plus masking currents, means to reduce by a fixed amplitude of said summation currents whenever they exceed the maximum signal amplitude, comprising means to subtract a fixed amplitude equal to the maximum signal amplitude, means to transmit the resulting currents to a receiving point, and means to recover the signal from the transmitted currents comprising means to subtract from the transmitted currents varying currents identical to the masking currents, and means to add a fixed amplitude to those currents resulting from the subtraction of said fixed amplitude from said summation currents prior to transmission.

14. In a secret signal transmission system in which duplicate records are employed to produce identical masking waves at separated transmitting and receiving points together with means for combining the masking waves with the transmitted and received waves, means for maintaining proper frequency and phase relations between the masking waves at transmitting and receiving points comprising means to record a pilot wave on each record, and means controlled by the pilot wave on each record for governing the reproduction rate of the masking waves from the respective record.

15. A system according to claim 14 including an amplifier for the reproduced masking waves from a said record, and means for automatically controlling the gain of said amplifier by means of the pilot wave recorded on said record.

16. In a system of secret transmission of signals, a plurality of low frequency signal channels, a corresponding plurality of secret key current sources, a line, rotary distributor means for switching signal currents from said signal channels to said line in rotation, means to simultaneously add to each such switched signal current a respective one of said secret key currents, thereby producing summation currents, and a common reentry circuit between said distributor and said line for reducing by a fixed quantity the amplitude of each summation current in excess of a predetermined maximum.

17. A receiving circuit for secretly transmitted signals composed of combination of signal and key currents, said circuit comprising a source of duplicated key currents, means to combine said duplicate key currents with the secretly transmitted currents to extract signal currents freed of the key currents, said means comprising distributor means for combining said key currents with received currents in succession, a common output circuit for the combined currents and a reentry circuit in said common output circuit for adding a fixed amplitude current to only certain of the combined currents as required to restore the signals to normal form.

* * * * *